US011827399B2

(12) United States Patent
Abston et al.

(10) Patent No.: US 11,827,399 B2
(45) Date of Patent: Nov. 28, 2023

(54) FUNNELS FOR PACKAGE FILLING

(71) Applicant: Sargento Foods Inc., Plymouth, WI (US)

(72) Inventors: James Abston, Plymouth, WI (US); Tim Veldman, Plymouth, WI (US); Jon Sommer, Plymouth, WI (US); Aaron Strand, Plymouth, WI (US)

(73) Assignee: Sargento Foods Inc., Plymouth, WI (US)

( * ) Notice: Subject to any disclaimer, the term of this patent is extended or adjusted under 35 U.S.C. 154(b) by 0 days.

(21) Appl. No.: 17/734,257

(22) Filed: May 2, 2022

(65) Prior Publication Data

US 2022/0258896 A1 Aug. 18, 2022

Related U.S. Application Data

(62) Division of application No. 17/106,578, filed on Nov. 30, 2020, now abandoned.

(51) Int. Cl.
*B65B 39/12* (2006.01)
*B65B 1/06* (2006.01)

(52) U.S. Cl.
CPC ..... *B65B 39/12* (2013.01); *B65B 1/06* (2013.01)

(58) Field of Classification Search
CPC ..... B65B 1/06; B65B 39/12; B67C 11/02
USPC ..... 53/473
See application file for complete search history.

(56) References Cited

U.S. PATENT DOCUMENTS 3,371,461 A * 3/1968 Aronson ..... B65B 39/145 53/511
4,848,421 A 7/1989 Froese et al.
9,393,179 B2 * 7/2016 Kawata ..... A61J 7/0076
2006/0108022 A1 * 5/2006 Carter ..... B65B 39/12 141/340

FOREIGN PATENT DOCUMENTS

WO WO-2005039324 A2 * 5/2005 ..... A01J 21/02

OTHER PUBLICATIONS

University of Michigan website: Definition of a Hopper Found at: https://encyclopedia.che.engin.umich.edu/hoppers/#7Q7S6Z9B7OH3V8Y09Z0P (Year: 2023).*
Bossar Packaging; "Bossar Packaging horizontal form fill and seal machine"; dated Dec. 31, 1990—(1) page.
Sargento Foods Inc.; "Sargento Funnel"; dated Dec. 18, 1992—(1) page.
Sargento Foods Inc.; "Sargento Lance Assembly"; dated Dec. 18, 1992—(1) page.
Southern; "duckbill"; https://www.southernpackaging.com/videos/duckbill/; screen shot dated Dec. 2, 2020.

* cited by examiner

*Primary Examiner* — Umashankar Venkatesan
*Assistant Examiner* — Christopher M Afful
(74) *Attorney, Agent, or Firm* — Boyle Fredrickson, SC

(57) ABSTRACT

Funnels are disclosed for use with filling packages with bulk product.

18 Claims, 21 Drawing Sheets

FUNNELS FOR PACKAGE FILLING

CROSS REFERENCE TO RELATED APPLICATIONS INVENTION

This application is a divisional of U.S. Non-Provisional application Ser. No. 17/106,578, filed Nov. 30, 2020, the contents of which are incorporated by reference herein.

FIELD OF THE INVENTION

The invention relates to funnels for transferring bulk products such as food products into a package.

BACKGROUND OF THE INVENTION

When filling a package with a bulk product, the bulk product typically falls from a weight scaling system and is shaped into a smaller cross-section by a funnel so as to fit into the package. The package has an opening in a common plane of a specific cross-sectional area. The funnel has a cross-sectional area that must be considerably less than the cross-sectional area of the package in order to consistently get the bulk product into the package. Commonly, a closed duckbill, which is easy to fit into an open package, is put at the exit of the funnel. After the duckbill is lowered into the package, it is opened so that product may then enter the package. However, after exiting the funnel and entering the open duckbill, the product is no longer contained on all four sides, rather, having an opening on two of the sides so that product is prone to spill out of and not enter the package, causing product loss and weight inaccuracies. Lances to gas flush the package are typically mounted slightly above the package and away from motion of the duckbill and are therefore subject to the Coanda effect which states that in free surroundings, a jet of fluid entrains and mixes with its surroundings as it flows away from a nozzle. In an alternate design, a duckbill is not utilized and both the funnel and lances are lowered into the package independent of each other to better contain the product and to eliminate the Coanda effect.

At the time of filling the package such as with bulk food product, atmospheric oxygen must be displaced in the interior of the package with a gas mixture of nitrogen and carbon dioxide for example to prevent the bulk food product from molding and thus increasing shelf life. This is commonly accomplished using a gas lance that direct a gas mixture under pressure into the filled package. Such lances are typically mounted alongside the funnel and duckbill and blow the gas mixture into the package without entering the package. Using this type of lance, the residual oxygen levels in the package remain well above 3% and, for example, with shredded cheese, an Oxygen scavenger needs to be added to attain the common extended shelf life. The lances must be positioned above and outside of the duckbill in order not to interfere with duckbill movement and with filling the package. Since the lances never enter the package, this design is subject to the Coanda effect. Accordingly, when the lances blow the gas mixture into the package from outside the package, oxygen is pulled into the package as well. Further, due to the small cross-sectional area into which the lance blows the gas mixture, the velocity of the gas mixture is high and the bulk food products are often blown out of the package causing food product loss and weight inaccuracies.

Using a Cartesian coordinate system, as the bulk product falls down through the funnel, it falls in the z axis direction. The funnel moves the bulk product in both the x axis direction and the y axis direction at the same time thus shaping the stream of bulk product in order to get it into the package. When the bulk product stream is being shaped simultaneously in the x axis and y axis directions, it is referred to as the funnel effect and is prone to funnel plugs which cause manufacturing delays.

SUMMARY OF THE INVENTION

In one construction, the disclosure provides a funnel assembly for transferring bulk products in a z axis, x axis and y axis direction to a package comprising an intermediate funnel having an entry end wherein bulk products enter the funnel assembly, the intermediate funnel configured such that bulk products travel through the intermediate funnel in a stream in the z axis direction and the stream is shaped in the x axis direction without being shaped in the y-axis direction; and a funnel having a coped exit end where the stream of bulk products exits the funnel assembly and enters a package, the funnel is configured such that bulk products travel through the funnel in the stream in the z axis direction and the stream is shaped in the y axis direction without being shaped in the x axis direction before exiting the funnel at the coped exit end and entering the package, wherein before the funnel completes the shaping of the stream in the y axis direction, the cross-sectional area of the coped exit end is substantially greater than the cross-sectional area of the package having an opening in a common plane.

In another constructions, the disclosure provides a funnel assembly for transferring bulk shredded cheese in a z axis, a x axis and a y axis direction to a package comprising a funnel having walls oriented to enable a stream of bulk shredded cheese to travel through the funnel in a z axis direction, the walls are oriented to shape the stream traveling in the z axis direction first in an x axis direction without being shaped in an y-axis direction, and thereafter the walls are oriented to shape the stream traveling in the z axis direction in the y axis direction without being shaped in the x axis direction; a package for containing a portion of the stream of bulk shredded cheese, the package having a top edge; and a coped portion positioned in the package below the top edge.

In another construction, the disclosure provides a funnel assembly for transferring bulk shredded cheese in a z axis, a x axis and a y axis direction to a package comprising a first portion having walls that allow bulk shredded cheese to travel between the walls in a stream in a z axis direction, the walls are oriented to shape the stream in an x axis direction without being shaped in a y-axis direction; a second portion adjacent the first portion and having second walls that allow the stream from the first portion to travel between the second walls in the z axis direction, the second walls are oriented to shape the stream in the y axis direction without being shaped in the x axis direction; and a coped third portion adjacent the second portion and having third walls oriented to allow the stream from the second portion to travel between the third walls and enter a package.

Other aspects of the disclosure will become apparent by consideration of the detailed description and accompanying drawings.

DETAILED DESCRIPTION

Before any constructions of the disclosure are explained in detail, it is to be understood that the disclosure is not limited in its application to the details of construction and the arrangement of components set forth in the following description or illustrated in the following drawings. The disclosure is capable of other constructions and of being practiced or of being carried out in various ways.

Figure 1:
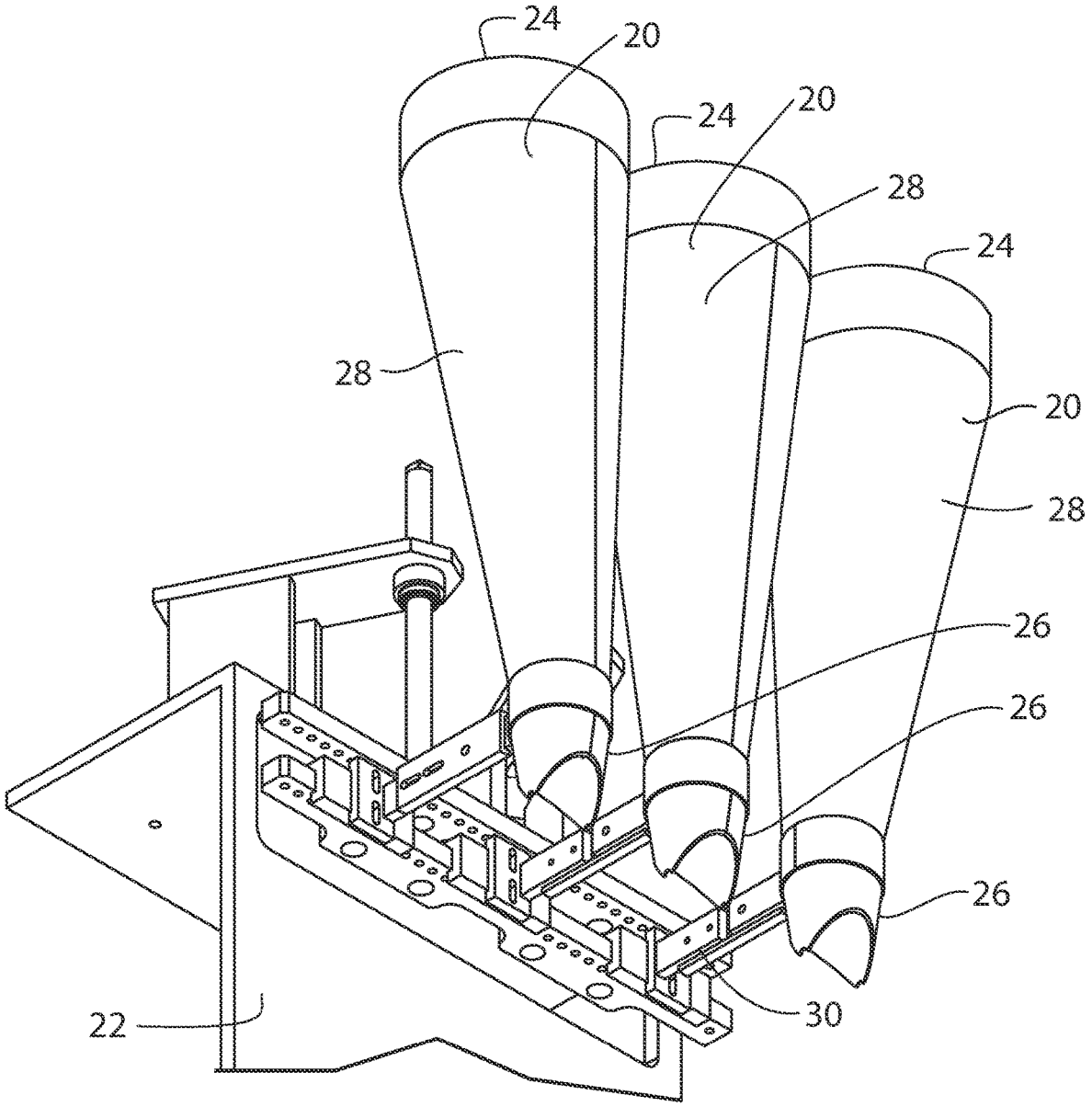
FIG. 1 is a perspective view of a coped funnel.
Figure 2:
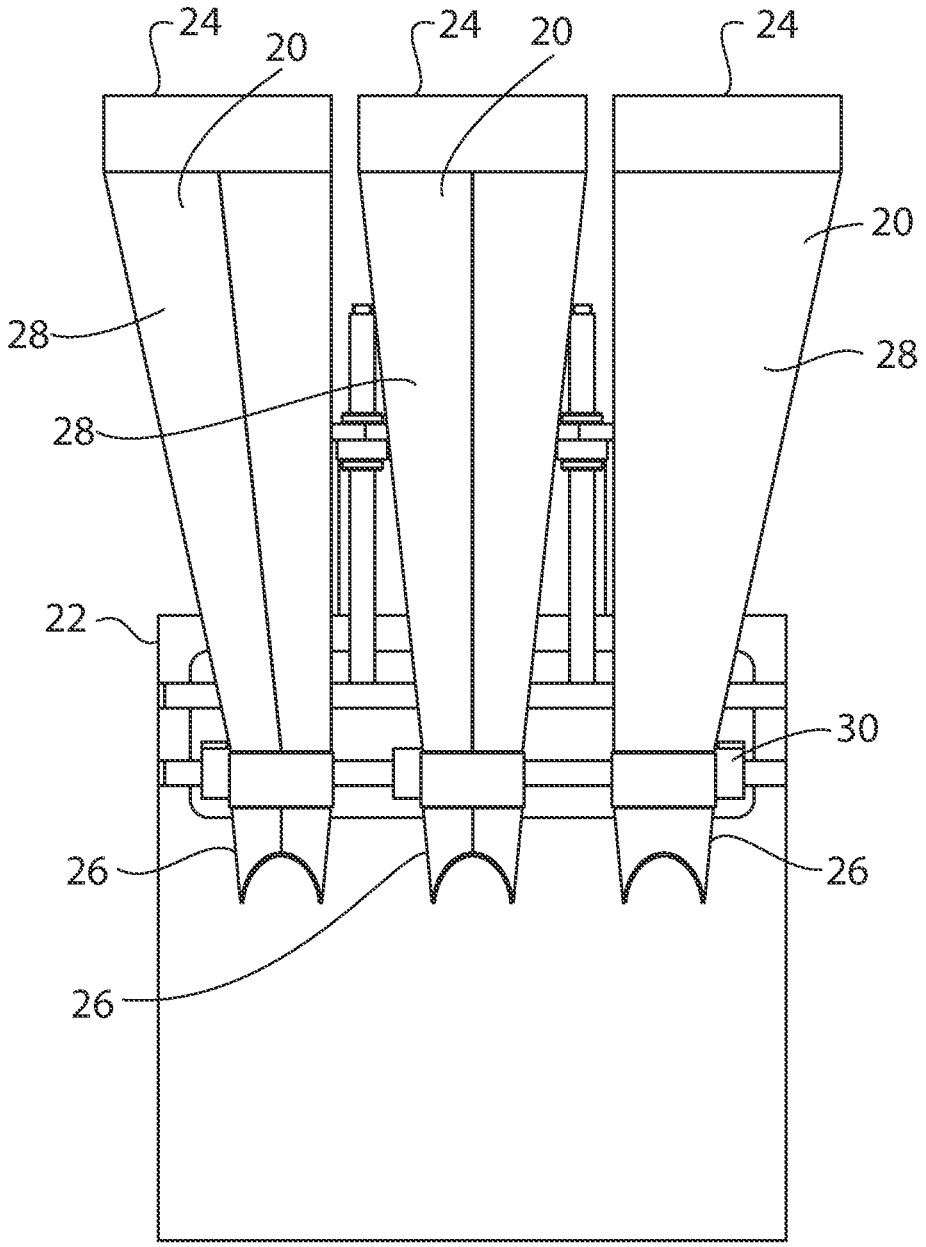
FIG. 2 is a front view of the coped funnel.
Figure 3:
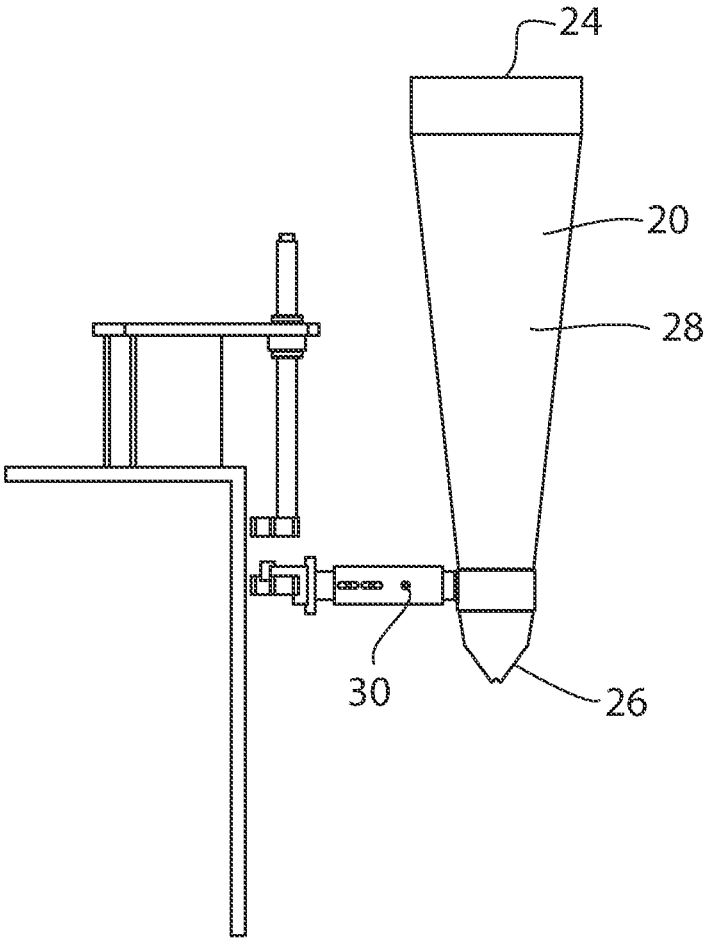
FIG. 3 is a side view of the coped funnel.
Figure 4:
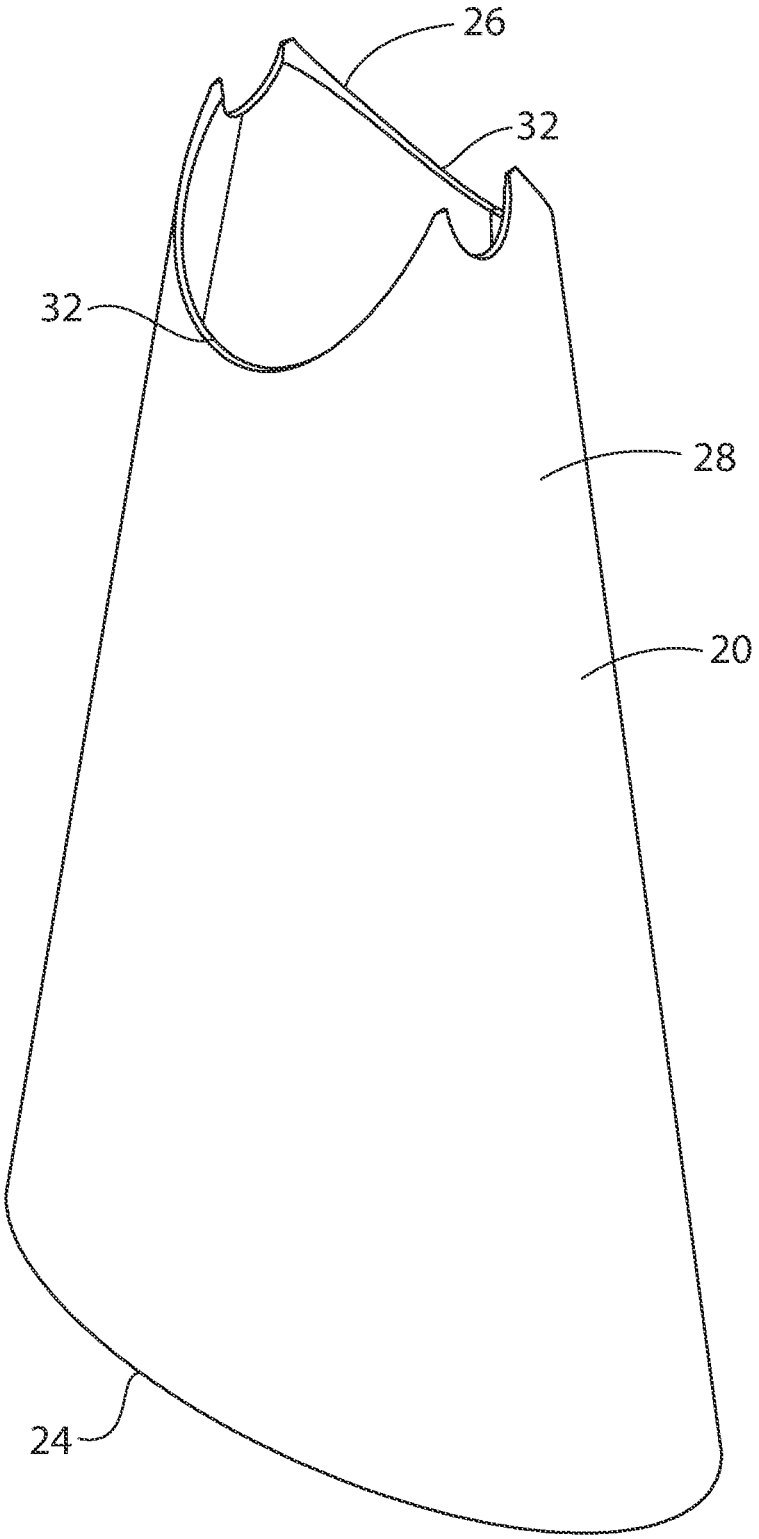
FIG. 4 is a perspective view of the coped funnel.
Figure 5:
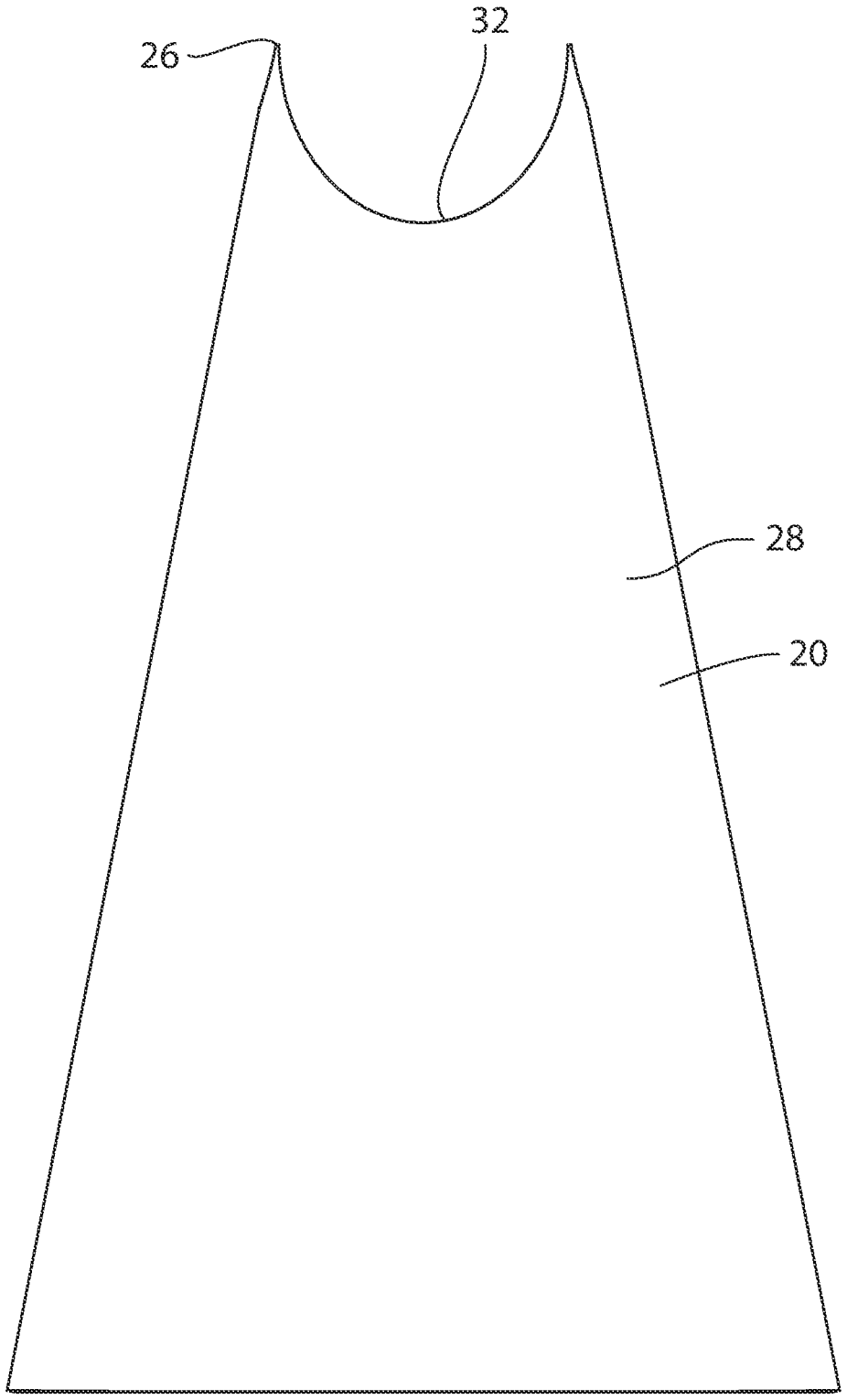
FIG. 5 is a front view of the coped funnel.
Figure 6:
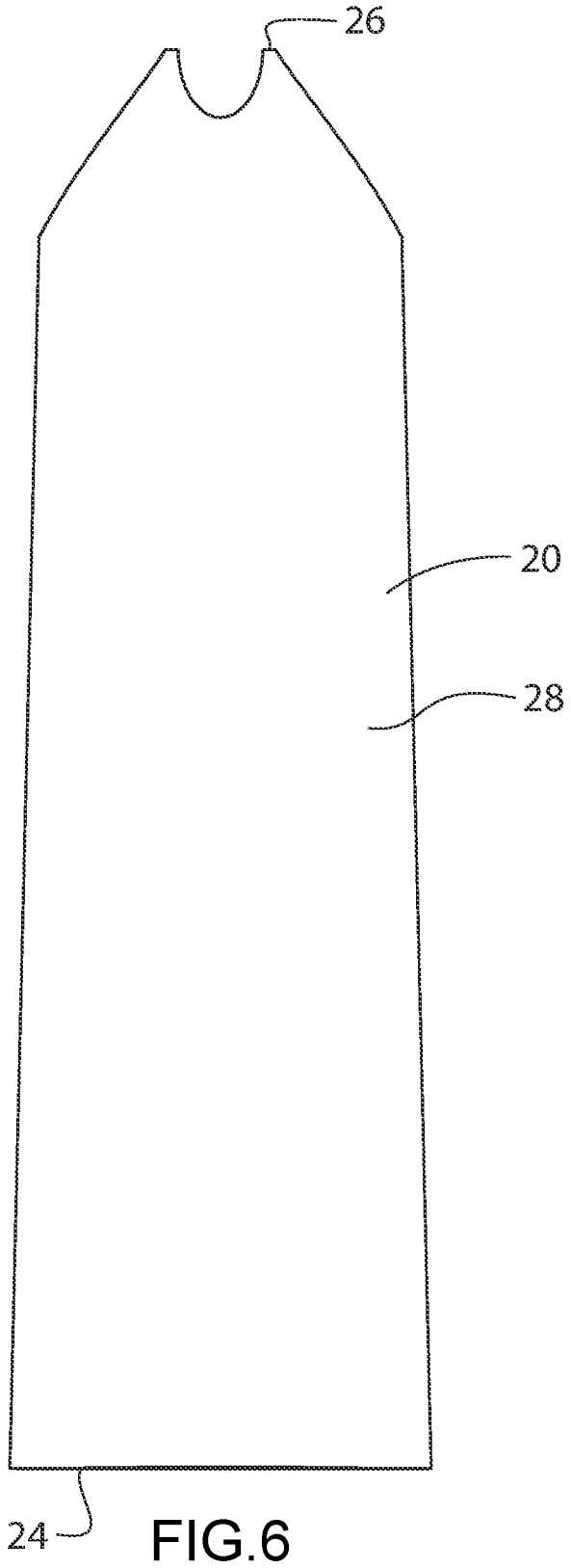
FIG. 6 is a side view of the coped funnel.
Figure 7:
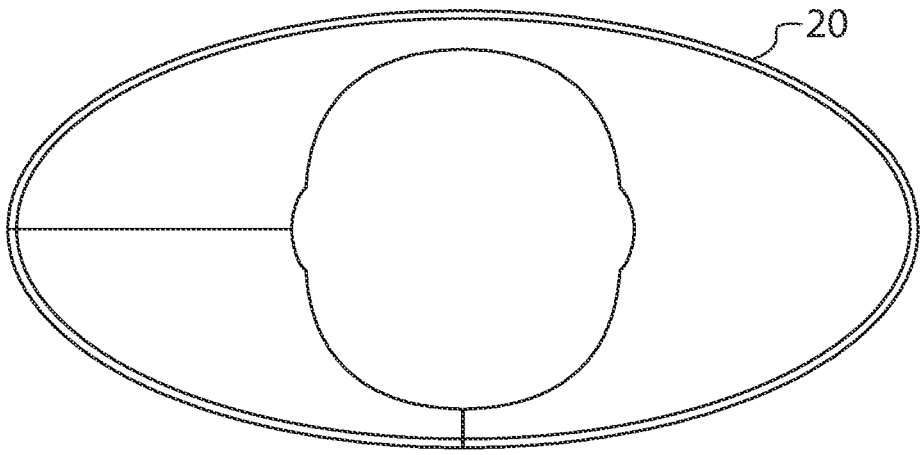
FIG. 7 is a top view of the coped funnel.

With reference to FIGS. 1-3, there is shown a funnel 20 in accordance with the present disclosure. The funnel 20 is part of a package filling system 22 on a manufacturing line designed to fill product packages with bulk products such as food products. For exemplary purposes, the invention will hereafter be described with respect to shredded cheese as the bulk product, however, the invention is not limited to shredded cheese or to other bulk food products.

The funnel 20 includes an entry end 24, a coped exit end 26 and a conical portion 28 therebetween. The shredded cheese enters the funnel 20 at the entry end 24, commonly from a weight scaling system (not shown), travels in a stream through the conical portion 28 then exits the funnel at the coped exit end 26. The funnel 20 is supported by a support assembly 30 that moves the funnel 20 vertically for package filling. There are no moving parts on the funnel itself such that the funnel 20 does not include a duckbill.

The term coped means that the exit end 26 has at least one cutout portion in the wall or walls of the funnel 20 walls. As such, other coped designs for the exit end besides that shown in the figures can also be used. The shape of the exemplary embodiment of the coped exit end 26 is particularly shown in FIGS. 4-7. The coped exit end 26 is wedge shaped with two opposing curved walls 32 where portions of the funnel wall have been removed. As will be discussed further below, two advantages that the coped exit end 26 with curved walls 32 provides the wedge shape helping plow open the package as the funnel 20 is lowered into the package and the cross-sectional area of the coped exit end 26 begins to increase substantially prior to the exit of the shredded cheese from the funnel 20.

Figure 8:
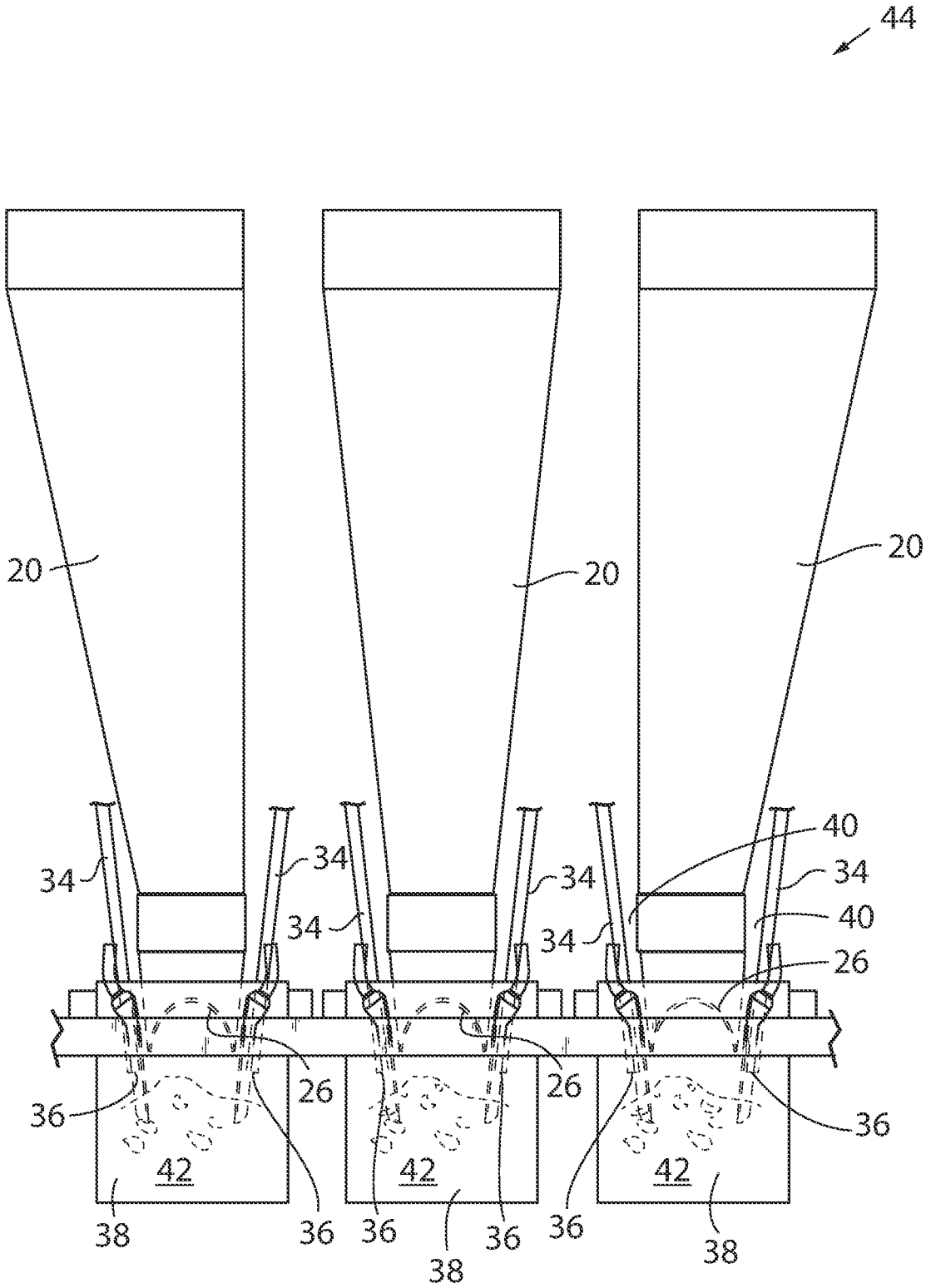
FIG. 8 is a front view of a funnel assembly filling a package.

As shown in FIG. 8, a pair of gas lances 34 are shown adjacent the funnel 20. It should be noted that one or more than two lances 34 can be utilized. The lances 34 are in communication with a gas supply (not shown) and have an exit end 36 where the gas leaves the lances 34. The lances 34 are preferably secured to the funnel 20 such as by welding or other securing methods. As compared to the prior art lances that moved independently of the funnel adding complexity and cost to the design and adding to the food safety risk if the lances rub against the funnel, the lances 34 of the present invention move with the funnel 20 simplifying the design and decreasing food safety risks. When the shredded cheese enters a package 38, the lances 34 are below the top of the package 38 in the interior 42. For example, the lances 34 can be approximately 3" below the top of the package 38 when the funnel 20 is at its lowest position, however, other distances can also be utilized. With the lances 34 secured to the funnel 20, the lances 34 are preferably the first thing to enter the interior 42 of the package 38 which eliminates the Coanda effect such that when the gas mixture is entering the package 38, it is not pulling in oxygen as well.

In operation on a manufacturing line and with reference to FIG. 8, a funnel assembly 44 consisting of the funnel 20 and the lances 34 are moved downwardly as a unit by the support assembly 30 (shown in FIGS. 1, 2 & 3) such that the exit end 26 of the funnel 20 and the exit end 36 of the lances 34 enter and remain in the interior 42 of the package 38. The shredded cheese is then dropped into the funnel 20 by the weight scaling system as the gas from the lances 34 enters the interior 42 of the package 38. The shredded cheese then travels through the funnel 20 and out of the coped exit end 26. When the set quantity of shredded cheese has entered the package 38, the funnel 20 and lances 34 are moved vertically upwardly out of the interior 42 of the package 38. With this funnel assembly 44 arrangement, the complexity and challenges of moving the lances 34 independent of the funnel 20 is eliminated. It would be noted that, in an alternate embodiment, the package 38 is moved upwardly to insert the funnel 20 and lances 34 into the package 38 then downwardly to remove the funnel 20 and lances 34 from the package 38.

Using the funnel assembly 44, residual oxygen levels in the filled packages 38 is at or below 2% such that an Oxygen scavenger are not needed to attain an extended shelf life. With the lances 34 entering the interior 42 of the package 38, the Coanda effect is eliminated such that oxygen from outside of the package 38 is not pulled into the package interior.

Using a funnel with a coped exit end 26 eliminates the need for a duckbill. The funnel 20 with a coped exit end 26 naturally and consistently plows open the package 38 and contains the shredded cheese in the interior 42 of the package 38 while reducing funnel plugs. The funnel 20 enables bulk product losses and weight inaccuracies to be minimized and often eliminated since the coped exit end 26 enters the interior 42 of the package 38 prior to filling with shredded cheese. Without the duckbill and the mechanism to open/close it, the funnel assembly 44 is easier to clean and reduces food product safety risks.

Turning now to FIGS. 9-16, a second embodiment of a funnel assembly 50 is shown and includes an intermediate funnel 52, a coped funnel 54 and a pair of gas lances 56. The funnel assembly 50 is supported by a support assembly 58 that moves the funnel assembly 50 vertically for package filling.

Figure 9:
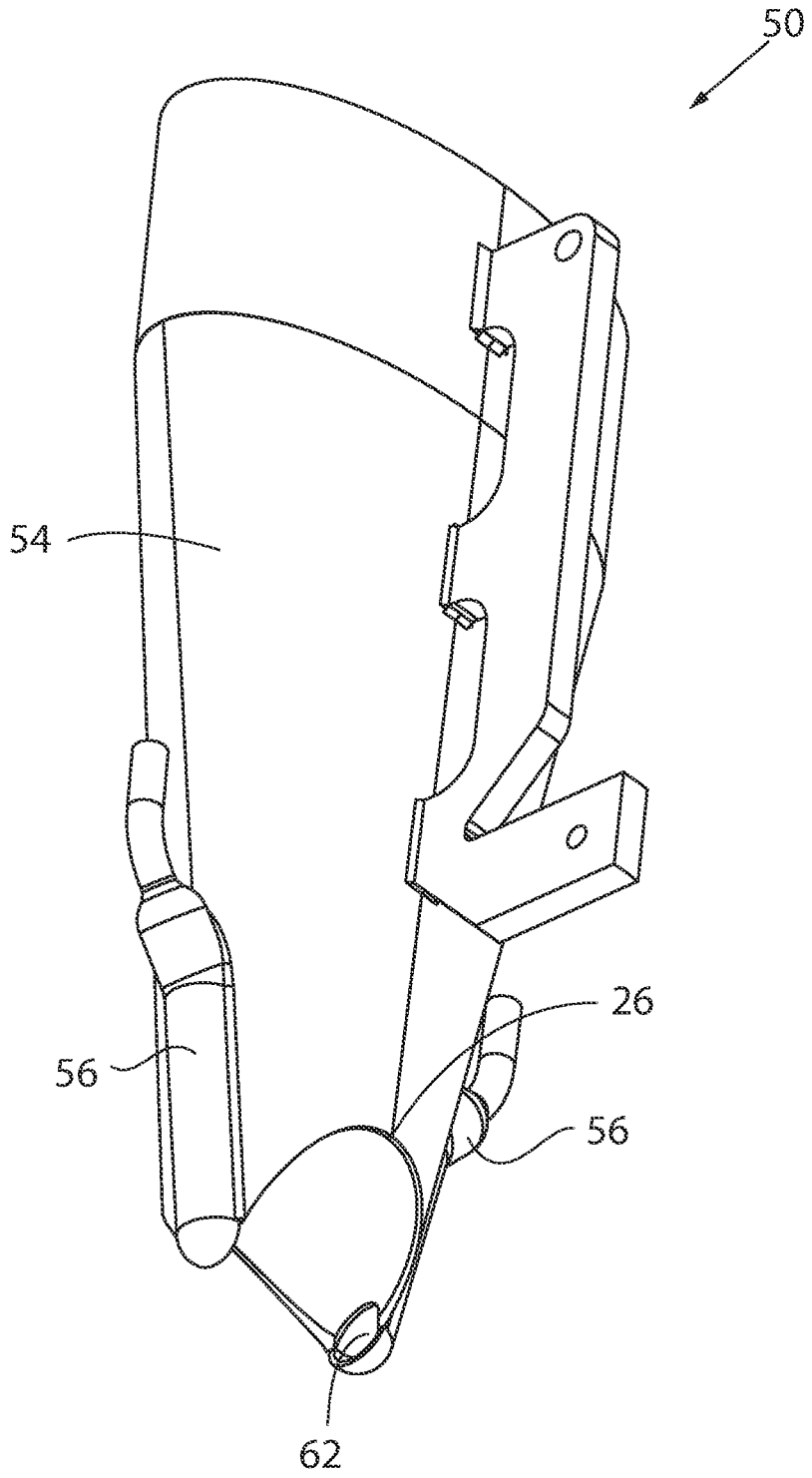
FIG. 9 is a perspective view of the coped funnel and gas lances.
Figure 10:
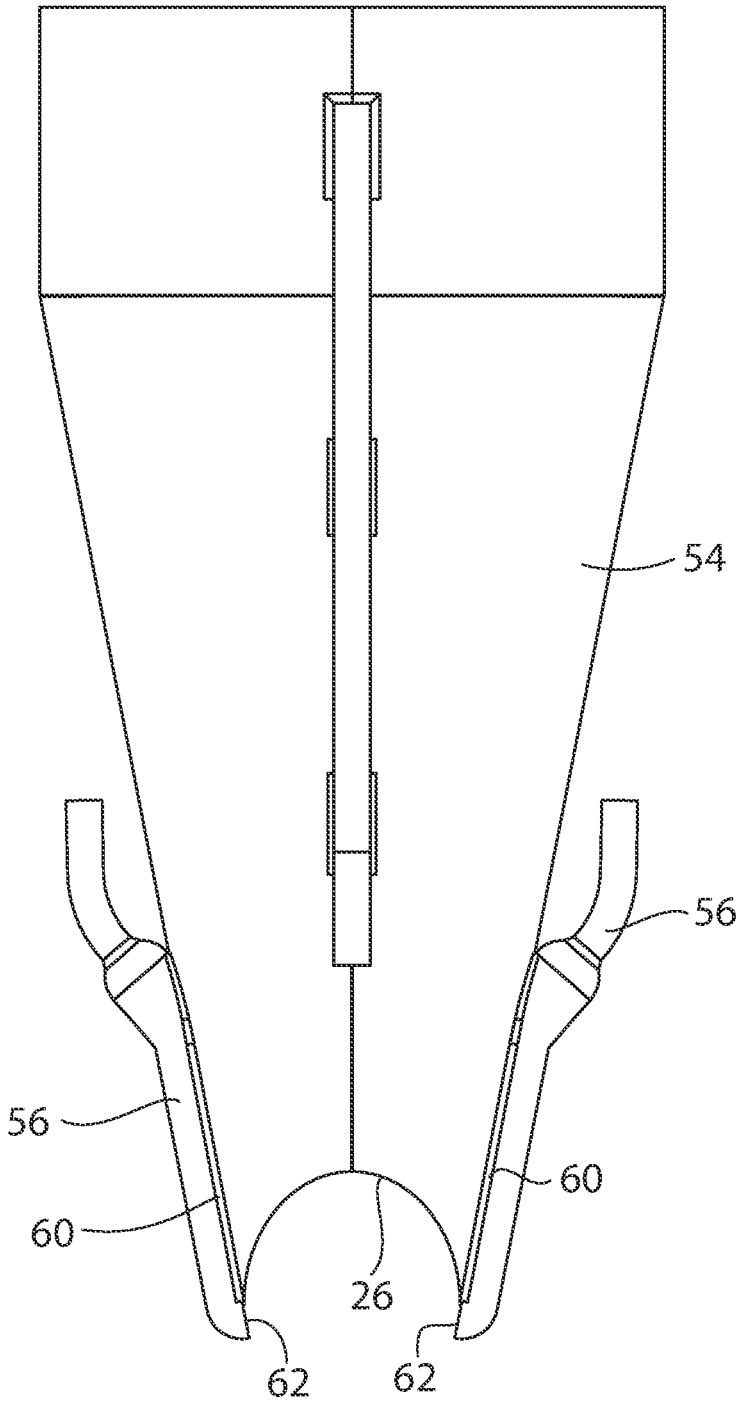
FIG. 10 is a back view of the coped funnel and the gas lances.
Figure 11:
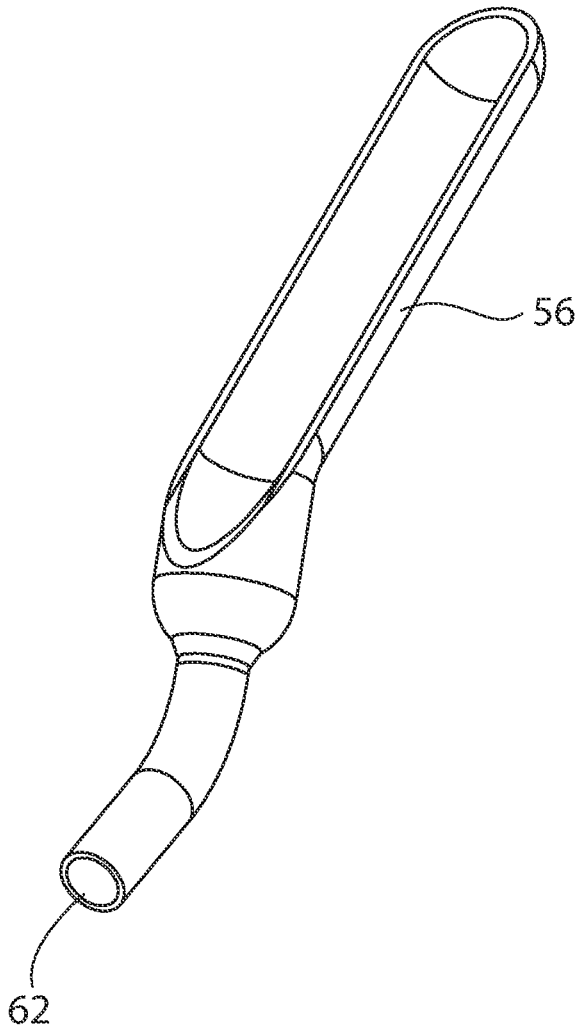
FIG. 11 is a perspective view of a gas lance.
Figure 12:
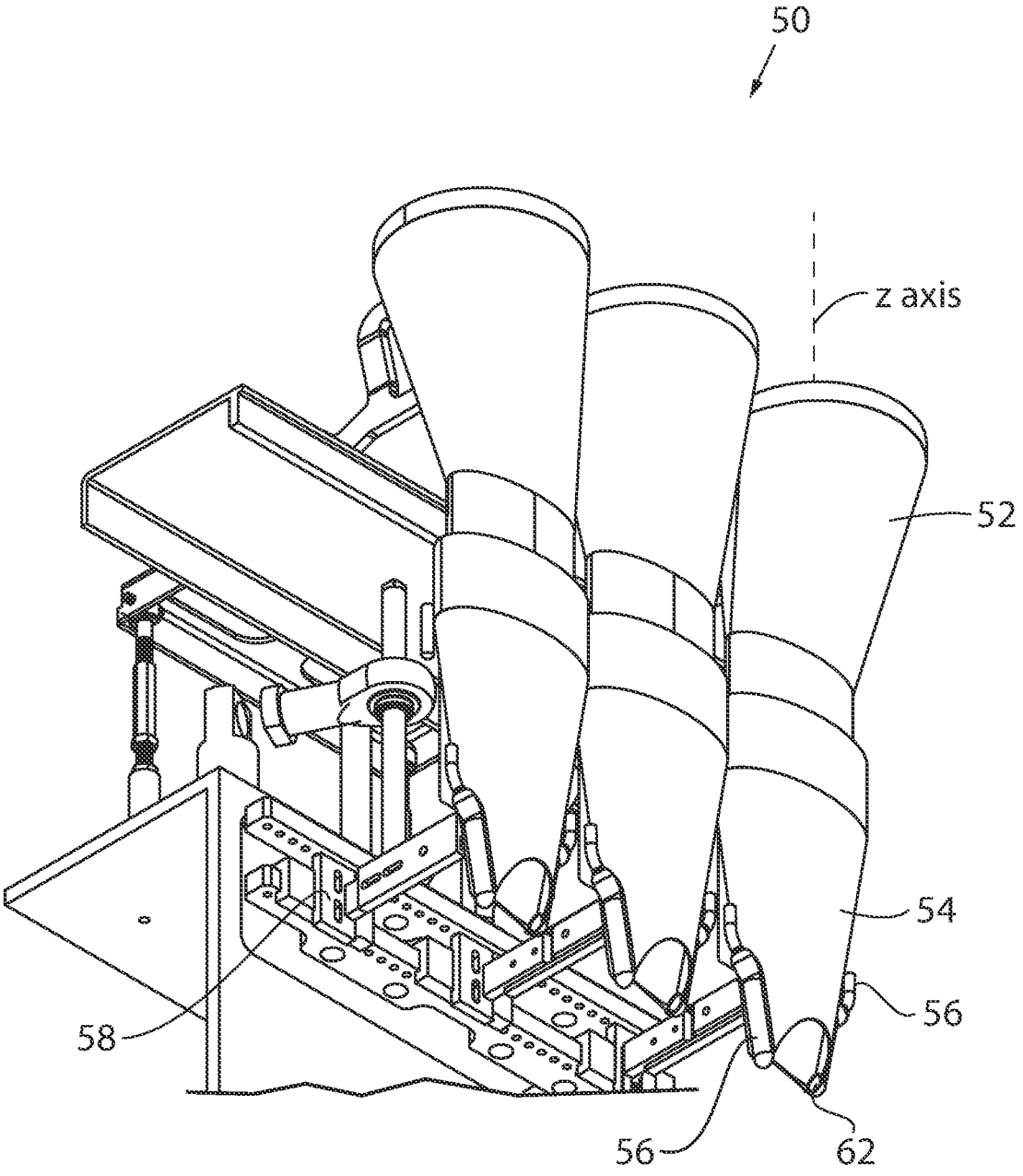
FIG. 12 is a perspective view of a second embodiment of the funnel assembly.

The coped funnel 54 is of a similar design to the funnel 20 described above and will use common reference numerals. The gas lances 56 share a common wall 60 with the coped funnel 54 as best shown in FIGS. 9-11 such that the cross-sectional area of the exit end 62 of the lances 56 can be increased such as by a factor of eight for example.

The intermediate funnel 52 is positioned above the coped funnel 54 in communication with the weight scaling system (not shown). As shown in the drawings, the intermediate funnel 52 and the coped funnel 54 are two separate funnels, however, it should be noted that the intermediate funnel 52 and the coped funnel 54 could be two portions of one funnel.

Using a Cartesian coordinate system, shredded cheese falls downwardly in a stream through the intermediate funnel 52 and then the coped funnel 54 in a z axis direction. As particularly shown in FIGS. 15-18, the intermediate funnel 52 has a sloped shape that enables the intermediate funnel 52 to shape the stream in the x axis direction without shaping it in the y axis direction. It should be noted that other configurations of the intermediate funnel can be utilized to shape the stream only in the x axis direction and not in the y axis direction.

Figure 13:
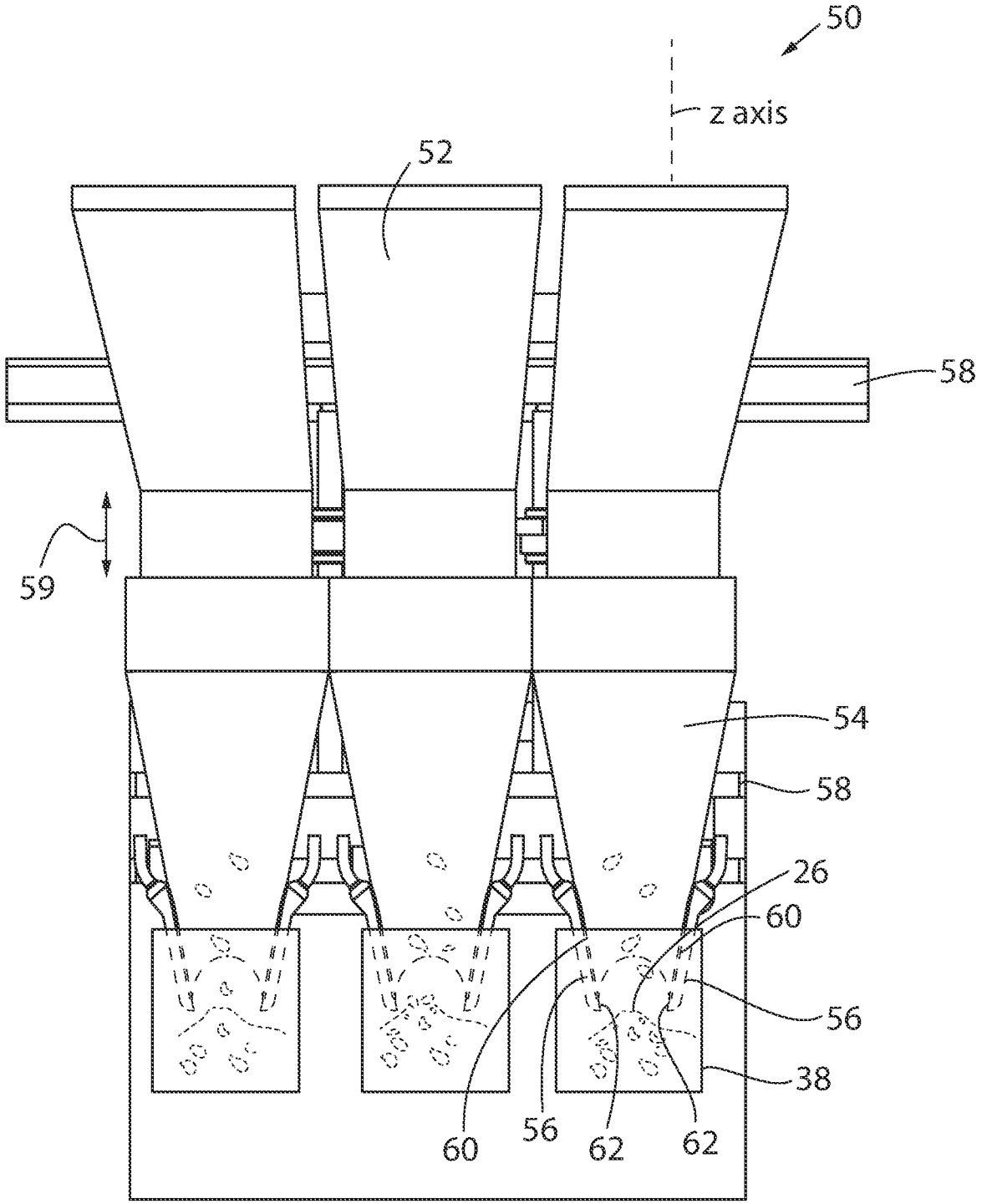
FIG. 13 is a front view of the second embodiment of the funnel assembly filling a package.
Figure 14:
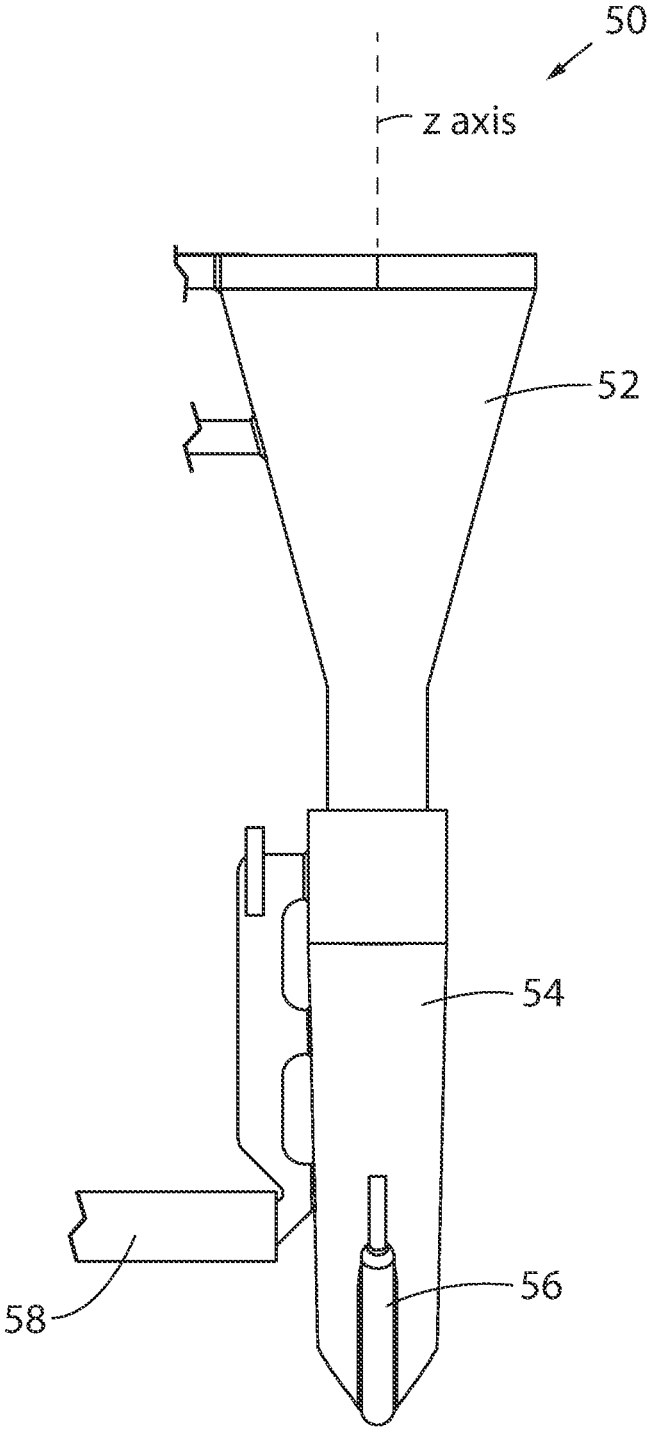
FIG. 14 is a side view of the second embodiment of the funnel assembly.
Figure 15:
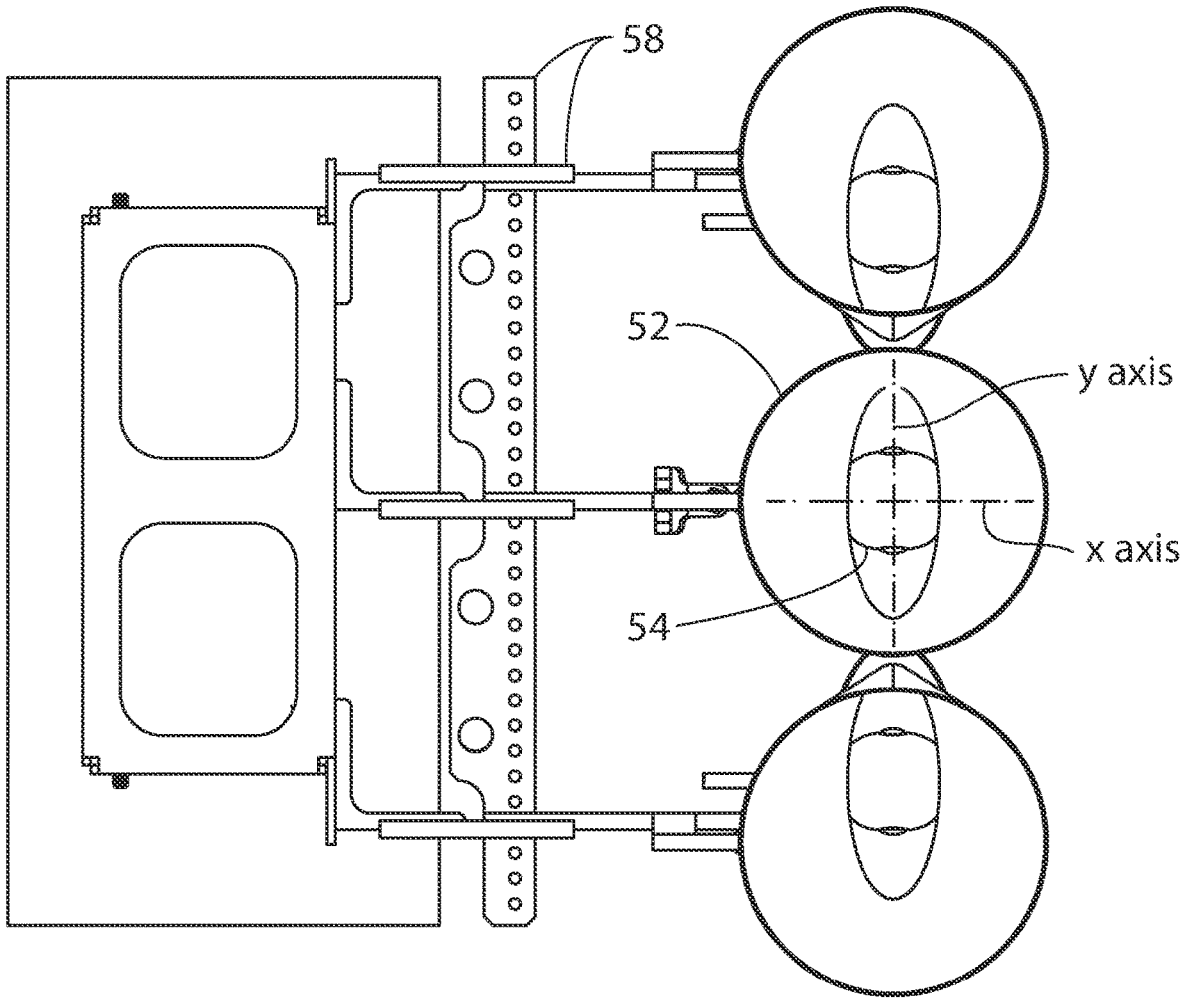
FIG. 15 is a top view of the second embodiment of the funnel assembly.
Figure 16:
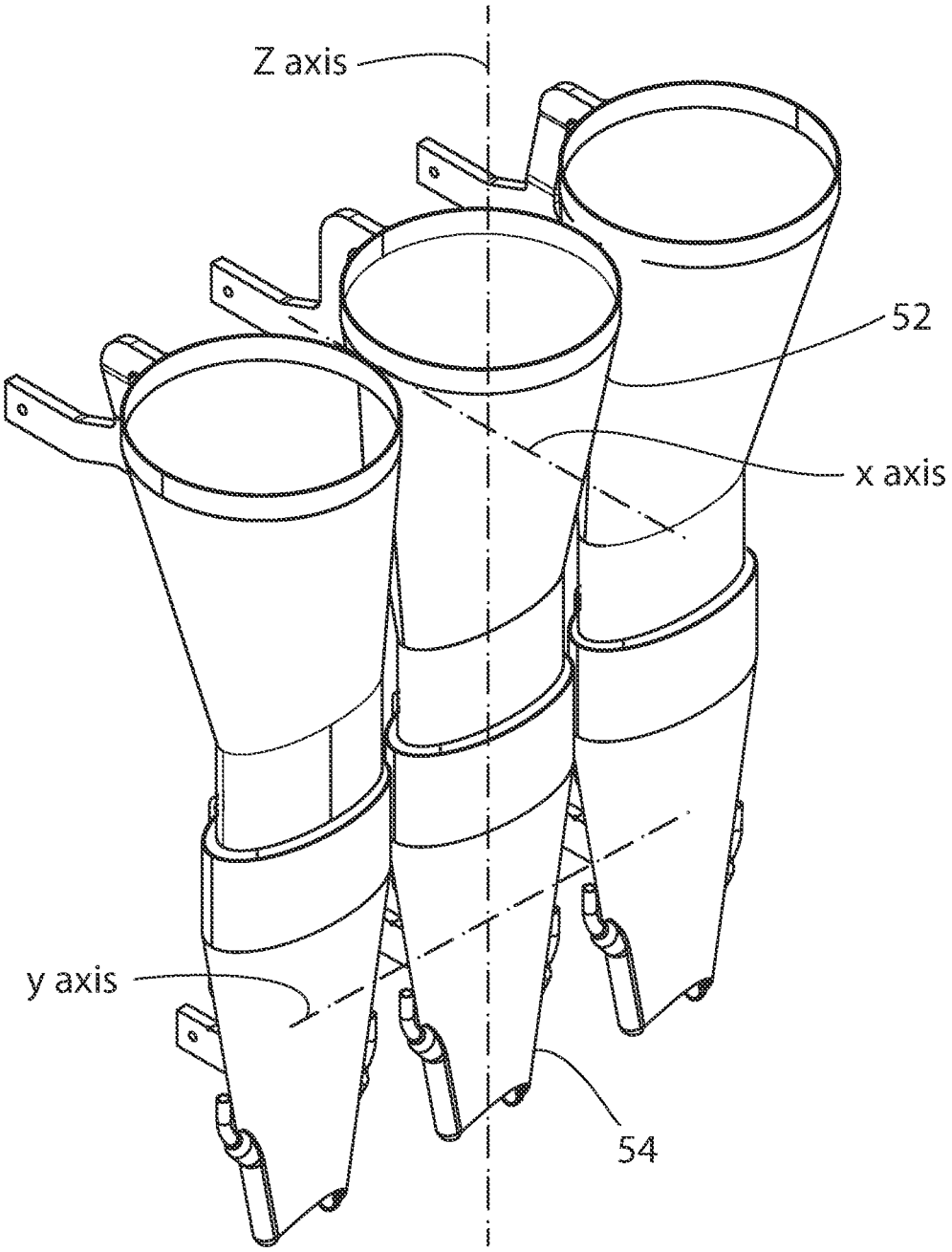
FIG. 16 is a perspective view of the second embodiment of the funnel assembly.
Figure 17:
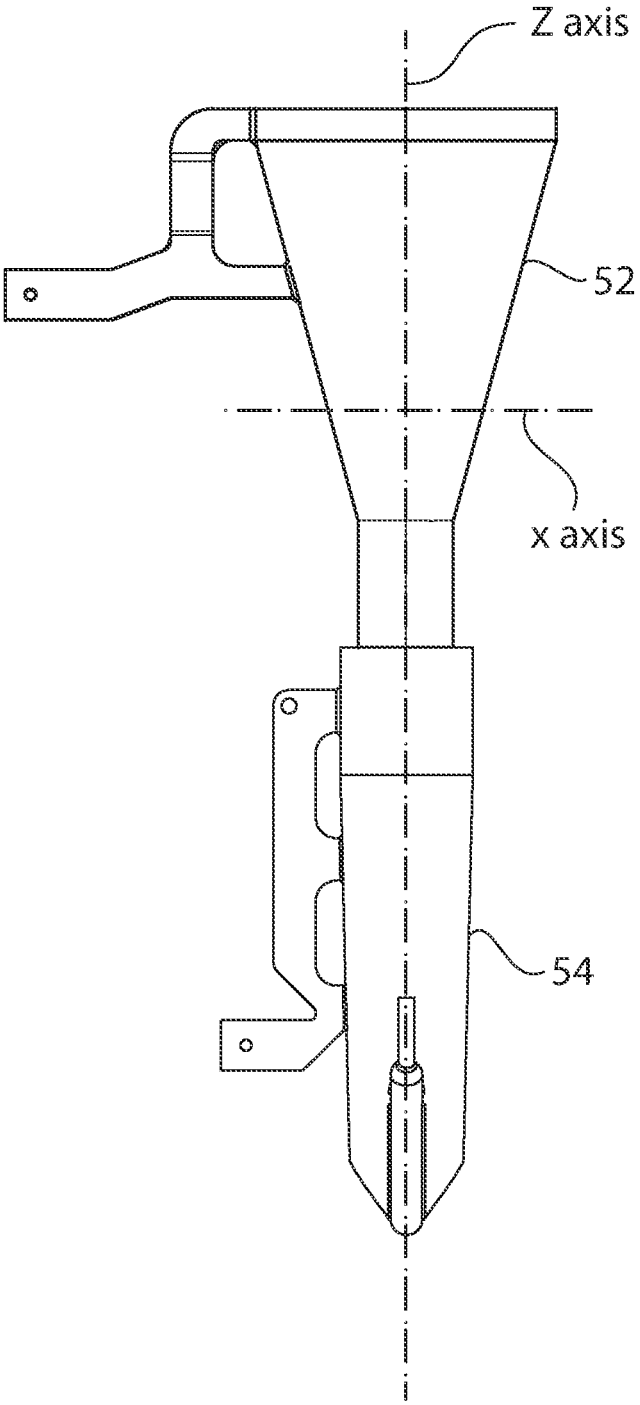
FIG. 17 is a side view of the second embodiment of the funnel assembly.
Figure 18:
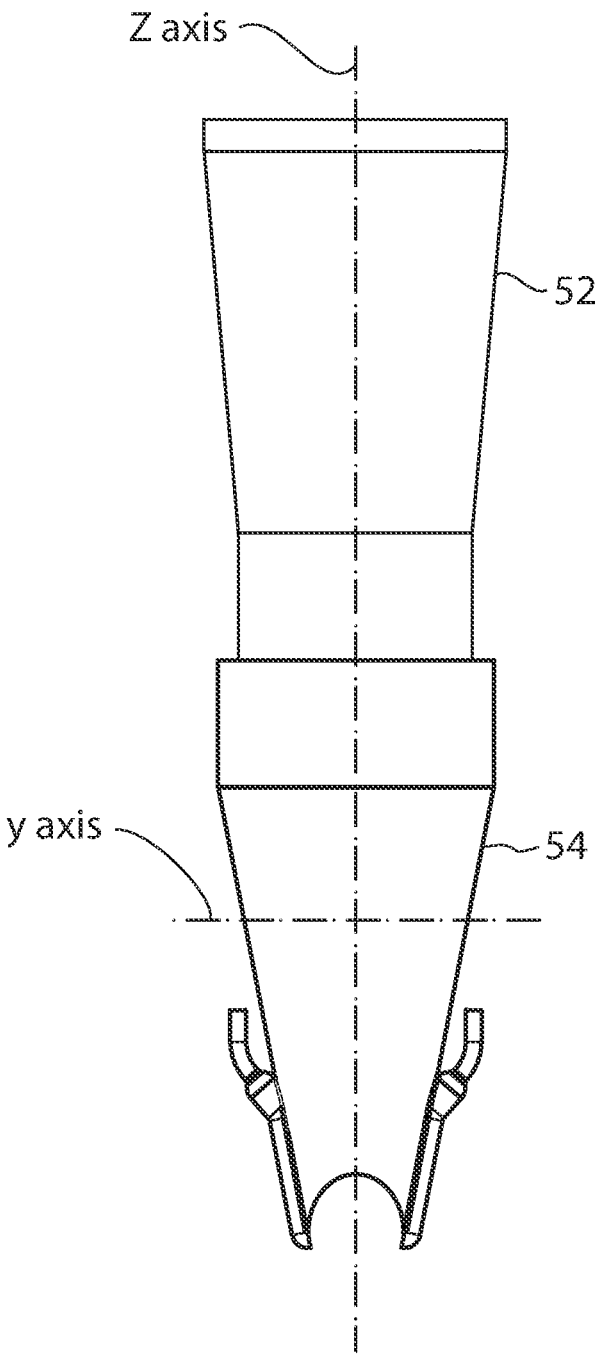
FIG. 18 is a front view of the second embodiment of the funnel assembly.

In operation on a manufacturing line and with reference to FIG. 13, the coped funnels 54 and the lances 56 are moved downwardly as a unit by the support assembly 58, along vertical path 59, such that the exit ends 26 and 62 of the coped funnel 54 and the lances 56 respectively enter and remain in the interior 42 of the package 38. Shredded cheese is then dropped into the intermediate funnel 52 by the weight scaling system as the gas from the lances 56 enters the package 38. The stream of shredded cheese travels downwardly in the z axis direction through the intermediate funnel 52 and, at the same time, the intermediate funnel 52 shapes the stream in the x axis direction without shaping it simultaneously in the y axis direction. After entering the coped funnel 56, the stream is shaped in the y axis direction such that there is a staggered alignment of the stream, eliminating the funnel effect when the stream is shaped simultaneously in both the x & y directions. By eliminating the funnel effect, funnel plugs are minimized and often eliminated. Before the coped funnel 54 completes the shaping of the stream in the y axis direction, the coped exit end 26 begins such that the cross-sectional area of the opening begins to increase substantially as the shredded cheese continues to fall. Consequently, funnel plugs are minimized even further, or completely eliminated. The coped exit end 26 begins prior to reaching the smallest cross-sectional area required to get into the package 38, having an opening in a common plane of a specific cross-sectional area. When the shredded cheese enters the package 38, the coped exit end 26 is entirely in the interior 42 of the package 38.

When the set quantity of shredded cheese has entered the package 38, the coped funnel 54 and the lances 56 are moved vertically upwardly, along the vertical path 59, out of the interior 42 of the package 38. With this funnel assembly 50 arrangement, the complexity, increased cost and food safety challenges of moving the lances 56 independent of the coped funnel 54 is eliminated. It should be noted that, in an alternate embodiment, the package 38 is moved upwardly to insert the coped funnel 54, the intermediate funnel 52 and the lances 56 into the interior 42 of the package 38 then downwardly to remove the coped funnel 54 and lances 56 from the package 38.

Figure 19:
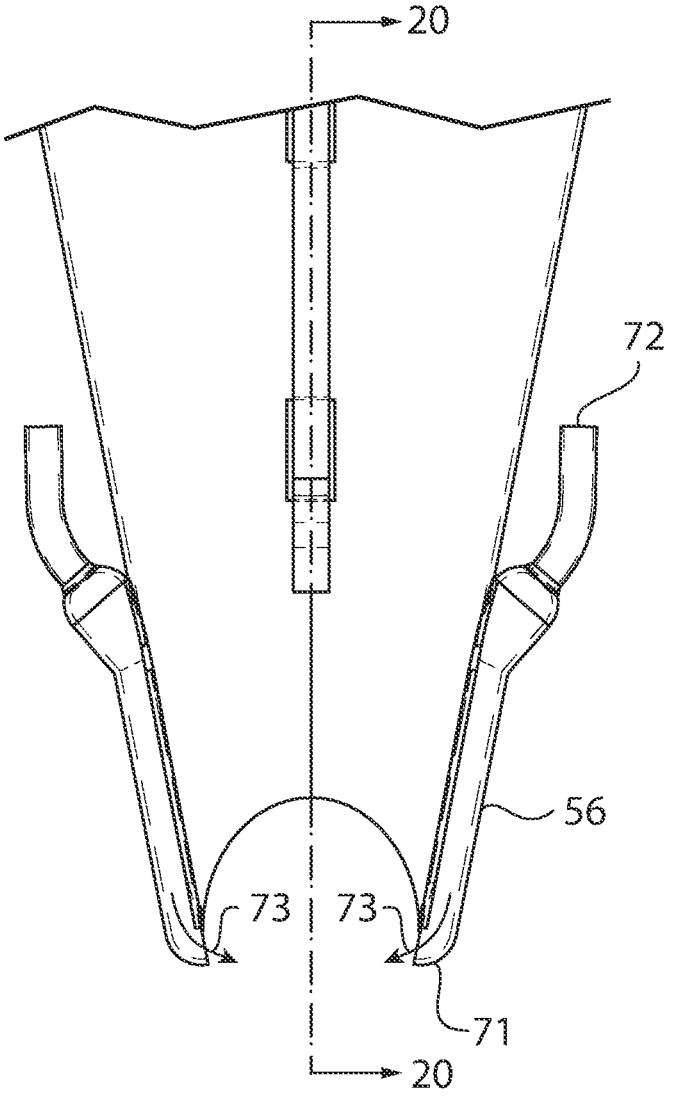
FIG. 19 is a front view of the coped funnel and gas lances.
Figure 20:
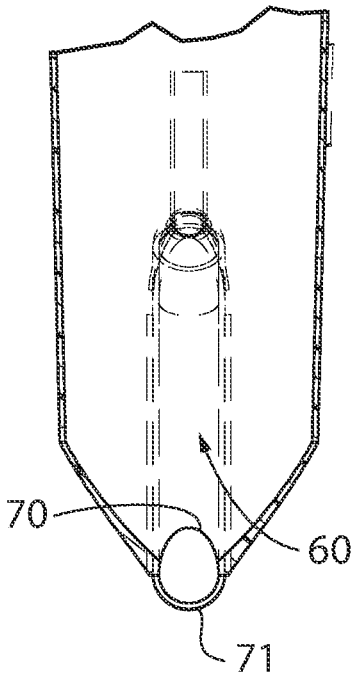
FIG. 20 is a sectional view taken along line 20-20 of FIG. 19.

Using a common wall 60 between the coped funnel 54 and lances 56 increases the cross-sectional area of both coped funnel 54 and the lances 56. More specifically, and referring back to FIG. 8, the space 40 between funnel 20 and lances 34 is added to the cross-sectional area of both funnel and lances. As shown in FIG. 9, this added cross-sectional area in the funnel 54 further decreases the probability of funnel plugs. This added cross-sectional area in the lances 56 decreases the velocity of the gas mixture flowing through the lances. This velocity is decreased even further at exit end 62 by changing the exit geometry as shown in FIGS. 19 and 20. The exit end 62 has a vertical orientation beginning at point 70 and ending at point 71. This vertical orientation cross-section is several magnitudes greater than the horizontal orientation cross-section, at the entrance 72 to the lance 56. By increasing cross-section by several magnitudes, the velocity decreases by several magnitudes, and turbulent flow becomes laminar flow. The laminar flow more effectively and consistently fills the package 38 with gas mixture, resulting in lower residual oxygen levels to be below 1% on some cheese types and consistently below 2% on all cheese types such that an Oxygen scavenger need not be added to attain the common extended shelf life. Additionally, the decreased velocity of the gas mixture in the package 38 substantially reduces or eliminates the shredded cheese and cheese fines being blown out of the package 38, decreasing food product loss and weight inaccuracies. In FIGS. 19 and 20, the geometry of the exit end 62 directs the gas flow as shown by arrow 73 almost perpendicular to the direction of the bulk product flow, facilitating the gas flow to penetrate into less dense products that have more entrapped atmospheric oxygen.

Figure 21:
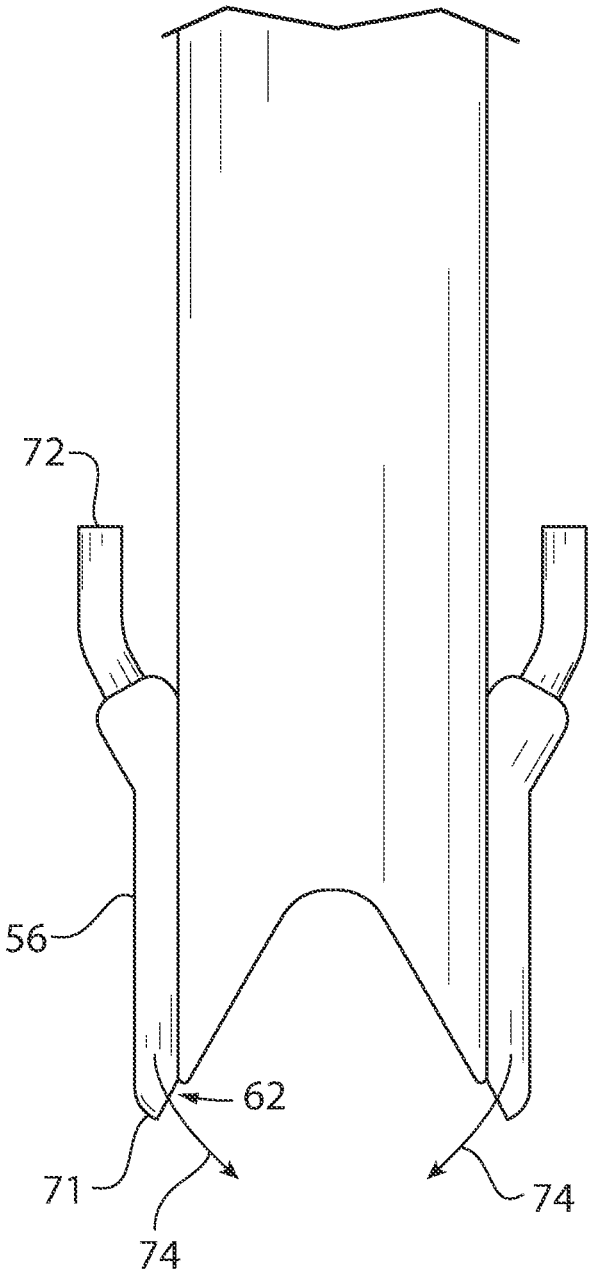
FIG. 21 is a front view of an alternate geometry of the coped funnel and gas lances.

As shown in FIG. 21, the vertical orientation of the geometry of the exit end 62 can be tipped slightly horizontal as shown by arrow 74 to help direct the gas flow more toward the bottom of the package 38. This geometry is advantageous for gas flushing deeper packages, or gas flushing at faster speeds. The semispherical geometry 71 at the end of lance 36 further enhances coped exit end 26 of the funnel 34, to naturally and consistently plow open the package 38 such that the product may flow freely and unobstructed into the package 38.

Various features and advantages of the invention are set forth in the following claims.

What is claimed is:

1. A funnel assembly for transferring a weight scaled amount of shredded cheese in a z axis, x axis and y axis direction to a package comprising:

an intermediate funnel having an entry end for receiving the weight scaled amount of shredded cheese, the intermediate funnel configured such that the weight scaled amount of shredded cheese travels through the intermediate funnel in a stream in the z axis direction and the stream is shaped in the x axis direction without being shaped in the y-axis direction; and a second funnel configured such that the weight scaled amount of shredded cheese travels through the second funnel in the stream in the z axis direction and the stream is shaped in the y axis direction without being shaped in the x axis direction, said second funnel terminating in a coped exit end adapted to be positioned in the package, wherein the second funnel continues to shape the steam in the y axis direction when the coped exit end is positioned in the package.

2. The funnel assembly of claim 1 wherein the coped exit end has at least one cutout.

3. The funnel assembly of claim 2 wherein the at least one cutout is curved.

4. The funnel assembly of claim 1 wherein the coped exit end has two cutouts.

5. The funnel assembly of claim 1 wherein the coped exit end is wedge shaped.

6. The funnel assembly of claim 1 wherein the second funnel has no moving parts.

7. A funnel assembly for transferring a weight scaled amount of shredded cheese in a z axis, a x axis and a y axis direction to a package comprising:

a funnel having walls oriented to receive a stream of the weight scaled amount of shredded cheese and enable the stream to travel through the funnel in a z axis direction, the walls are oriented to shape the stream traveling in the z axis direction first in an x axis direction without being shaped in an y axis direction, and thereafter the walls are oriented to shape the stream traveling in the z axis direction in the y axis direction without being shaped in the x axis direction and oriented to have an coped exit end positionable in the package, the funnel oriented so that the stream of the weight scaled amount of shredded cheese is already shaped in the x axis direction and continues to be shaped in the y axis direction as the stream enters the coped portion positioned in the package.

8. The funnel assembly of claim 7 wherein the coped portion has at least one cutout.

9. The funnel assembly of claim 8 wherein the at least one cutout is curved.

10. The funnel assembly of claim 7 wherein the coped portion has two cutouts.

11. The funnel assembly of claim 7 wherein the coped portion is wedge shaped.

12. The funnel assembly of claim 7 wherein the funnel has no moving parts.

13. A funnel assembly for transferring a weight scaled amount of shredded cheese in a z axis, a x axis and a y axis direction to a package comprising:

a first portion having walls for receiving and allowing the weight scaled amount of shredded cheese to travel between the walls in a stream in a z axis direction, the walls are oriented to shape the stream in an x axis direction without being shaped in a y axis direction;

a second portion adjacent the first portion and having second walls that allow the stream from the first portion to travel between the second walls in the z axis direction, the second walls are oriented to shape the stream in the y axis direction without being shaped in the x axis direction; and a coped third portion adjacent the second portion, positionable in the package and oriented to allow the stream from the second portion to continue to be shaped in the y axis direction when the coped end in positioned in the package.

14. The funnel assembly of claim 13 wherein the coped third portion has at least one cutout.

15. The funnel assembly of claim 14 wherein the at least one cutout is curved.

16. The funnel assembly of claim 13 wherein the coped third portion has two cutouts.

17. The funnel assembly of claim 13 wherein the coped third portion is wedge shaped.

18. The funnel assembly of claim 13 wherein the funnel has no moving parts.

* * * * *